US005443789A

United States Patent [19]

Harris et al.

[11] Patent Number: 5,443,789

[45] Date of Patent: Aug. 22, 1995

[54] LOW YTTRIUM, HIGH TEMPERATURE ALLOY

[75] Inventors: Kenneth Harris, Spring Lake; John M. Eridon, Whitehall; Steven L. Sikkenga, North Muskegon, all of Mich.

[73] Assignee: Cannon-Muskegon Corporation, Muskegon, Mich.

[21] Appl. No.: 977,899

[22] Filed: Nov. 18, 1992

Related U.S. Application Data

[63] Continuation-in-part of Ser. No. 944,458, Sep. 14, 1992, abandoned.

[51] Int. Cl.[6] ..... C22C 19/05

[52] U.S. Cl. ..... 420/443; 416/241 R; 416/223 R; 148/404

[58] Field of Search ..... 148/900, 239, 404, 410, 148/428; 428/941, 610; 416/241 R, 223 R; 415/200

[56] References Cited

U.S. PATENT DOCUMENTS

| | | | |
|---|---|---|---|
| 4,169,742 | 10/1979 | Mukusick et al. | 148/32.5 |
| 4,352,698 | 10/1982 | Hartley et al. | 148/239 |
| 4,388,124 | 6/1983 | Henry | 148/404 |
| 4,643,782 | 2/1987 | Harris et al. | 148/404 |
| 4,719,080 | 1/1988 | Duhl et al. | 420/443 |
| 4,885,216 | 12/1989 | Naik | 428/680 |
| 4,908,183 | 3/1990 | Chin et al. | 420/448 |
| 4,915,907 | 4/1990 | Shah et al. | 420/448 |
| 4,976,791 | 12/1990 | Ohno et al. | 148/404 |
| 5,068,084 | 11/1991 | Cetel et al. | 420/443 |
| 5,069,873 | 12/1991 | Harris et al. | 420/448 |
| 5,100,484 | 3/1992 | Wukusick et al. | 148/20.3 |
| 5,151,249 | 9/1992 | Austin et al. | 420/445 |
| 5,240,518 | 8/1993 | Wortman et al. | 148/410 |

FOREIGN PATENT DOCUMENTS

| | | | |
|---|---|---|---|
| 2029539 | 8/1990 | Canada | C22C 19/05 |
| 0155827 | 9/1985 | European Pat. Off. . | |
| 0362661 | 9/1989 | European Pat. Off. | C22C 19/05 |
| 1260982 | 1/1972 | United Kingdom . | |
| 2235697 | 3/1991 | United Kingdom | C22C 19/05 |

OTHER PUBLICATIONS

*Journal of Materials Engineering and Performance*, vol. 2, No. 4, Aug. 1993, Materials Park, Ohio, pp. 481–487, Harris et al. 'Development of Two Rhenium-Containing Superalloys for Single-Crystal Blade and Directionally Solidified Vane Applications in Advanced Turbine Engines'.

*Primary Examiner*—David A. Simmons
*Assistant Examiner*—Margery S. Phipps
*Attorney, Agent, or Firm*—Price, Heneveld, Cooper, DeWitt & Litton

[57] ABSTRACT

An improved nickel-based single crystal superalloy has both an extremely low sulphur content and a very low lanthanum, cerium, or lanthanum plus yttrium, or cerium plus yttrium, or content, whereby the amount while very low, is sufficient to react with the remaining available sulphur in the alloy and with sulphur from the fuel used in engine operation, such that the very thin, protective scale layer of aluminum oxide formed on the surfaces of the nickel-based alloy parts exposed to the very high temperatures incident in high efficiency turbine engines, will afford effective, long-life protection for the surfaces of these engine components, through the virtual elimination of spalling of the aluminum oxide scale during cyclic engine operations.

4 Claims, 3 Drawing Sheets

LOW YTTRIUM, HIGH TEMPERATURE ALLOY

SUMMARY OF THE INVENTION

This application is a continuation-in-part of application for U.S. Letters Patent, Ser. No. 07/944,458, filed Sep. 14, 1992, LOW YTTRIUM SUPERALLOY, now abandoned.

This invention relates to single crystal nickel-base superalloys and particularly to such an alloy characterized by very low sulphur content, thus, materially reducing the addition of an element having a high affinity for sulphur, such as yttrium for forming chemically stable compounds, such as yttrium oxysulphides and yttrium sulphides, to improve the cyclic, high temperature oxidation resistance of the alloy. Such an approach to this problem heretofore has not been either effective or practical for a number of reasons.

BACKGROUND OF THE INVENTION

One reason is the cost of the yttrium addition process coupled with the fact that appreciable quantities of yttrium have to be used to effectively reduce the available, active sulphur content in the alloy from 5–15 ppm to about 1 ppm by weight (w). Further, yttrium is itself a chemically very reactive element and will not only actively combine with sulphur but also with oxygen to form yttrium oxides and oxysulphides. These oxides ($Y_2O_3$) and oxysulphides ($Y_2O_2S$) can nucleate grain defects in single crystal nickel-base alloy castings making the castings unusable and, therefore, necessitating their rejection. Further, a nickel yttrium eutectic phase can form which has a low melting point, substantially reducing the solution heat treat temperature which can be applied to the single crystal components during manufacture. This is particularly important in the case of aircraft turbine engine airfoils subject to very high temperature operating environments, up to 2100° F. The restricted solution heat treat temperature results in reduced alloy strength and phase stability thus materially reducing turbine blade useful life.

This invention provides a workable solution to the problem of single crystal alloy cyclic oxidation resistance and phase stability under conditions of very high operating temperatures, for example at turbine blade tips, by substantially eliminating sulphur and at the same time materially reducing the quantity of yttrium required in the turbine blade components. It is not possible to entirely eliminate sulphur and, at the same time, it has been found to be impossible to entirely eliminate yttrium.

In an effort to develop an alloy having the desired characteristics for use in high efficiency gas turbine engines operating at high temperature, the alloy sold under the Cannon-Muskegon's trademark "CMSX-4" was considered to have the basic functional characteristics. This alloy is disclosed in U.S. Pat. No. 4,643,782, entitled "SINGLE CRYSTAL TECHNOLOGY" issued Feb. 17, 1987. This alloy has many of the characteristics which are desirable when applied to the high temperature turbine airfoils which are the objective of the improved alloy set out in this disclosure. As will be noted from Table I, the alloy of U.S. Pat. No. 4,643,782 includes, among other elements, 20 (w) ppm max. of sulphur. Also, 30–100 (w) ppm of yttrium may be included in the single crystal turbine airfoil components to appreciably improve bare alloy cyclic oxidation resistance, i.e., reduce aluminium oxide spalling, which is particularly important for the tip regions of modern, shroudless turbine blades and transpiration cooled turbine airfoils.

Sulphur has long been recognized as troublesome in this type of high temperature nickel-base alloy. Sulphur, although in small or trace amounts can be acquired by an alloy from the refractory linings or crucibles in which the alloy is melted or remelted at temperatures in the range 2700° F.–2850° F. To avoid this, the refractory linings in which the alloy is melted are made from costly and very pure materials. For this purpose, linings preferably made of magnesium oxide and aluminium oxide spinel-forming refractories are utilized. Vacuum induction furnace atmospheres have to be extremely clean and essentially sulphur-free.

In addition, very careful selection of raw materials used for the alloy is practiced to avoid unwanted addition of sulphur together with maintenance of ultra cleanliness of the vacuum induction furnaces and pumping systems. It should be noted that vapor booster oil contains sulphur and hence even slight back-streaming of vapor booster oil from the vacuum pumps into the furnace melting chamber or pouring chamber is not permissible. In the manufacture of the alloy, care is taken to keep sulfur at a very low level and also to maintain a very low oxide inclusion content. Extensive research and melting trials have found it possible to consistently produce CMSX-4 alloy with a sulphur content of 1 (w) ppm. This has now been done and repeated with six heats (V8256, V8276, V8277, V8291, V8311 and V8312) of 8000 lb. each with consistent reduction of sulphur from the former 4–6 (w) ppm range to a 0.8–1.7 (w) ppm range with an average of 1.0 (w) ppm. The analytical technique used for sulphur analysis is high resolution glow discharge mass spectrometry [GDMS]. It is postulated that phosphorus may play a similar deleterious role to sulphur. The phosphorus content of these heats has been reduced to a range of 0.7–1.1 (w) ppm, analyzed using GDMS.

Having, in effect, almost eliminated the sulphur problem there remains the yttrium problem. While the addition of yttrium has the dramatic effect of reducing cyclic, bare alloy oxidation almost to zero under high temperature operational conditions, yttrium has other undesirable effects upon other critical characteristics of the alloy. Yttrium forms a low melting point, eutectic phase identified as nickel yttrium which has a much reduced melting point, thus reducing the melting point for the entire alloy. Thus, the alloy's solution temperature is reduced to the point that the solution temperature necessary to enable the alloy to be fully solutioned and thus develop its important characteristics, that are, creep and fatigue strength and phase stability under sustained high temperature conditions, cannot be attained due to occurrence of unacceptable incipient melting, with attendant pore formation and excessive residual microsegregation.

Because of the high reactivity of yttrium it has heretofore been necessary to add an excess quantity of this element to obtain the results which are considered desirable in the finished casting. This, however, is not a desirable approach because yttrium is very reactive and at the elevated temperatures at which this alloy is single crystal cast, yttrium readily forms yttrium oxide inclusions from reaction with remelting ceramic crucibles, shell molds and cores which nucleate grain defects resulting in unacceptable, reject airfoil castings.

IN THE DRAWINGS

DESCRIPTION OF THE PREFERRED EMBODIMENT

Figure 1:
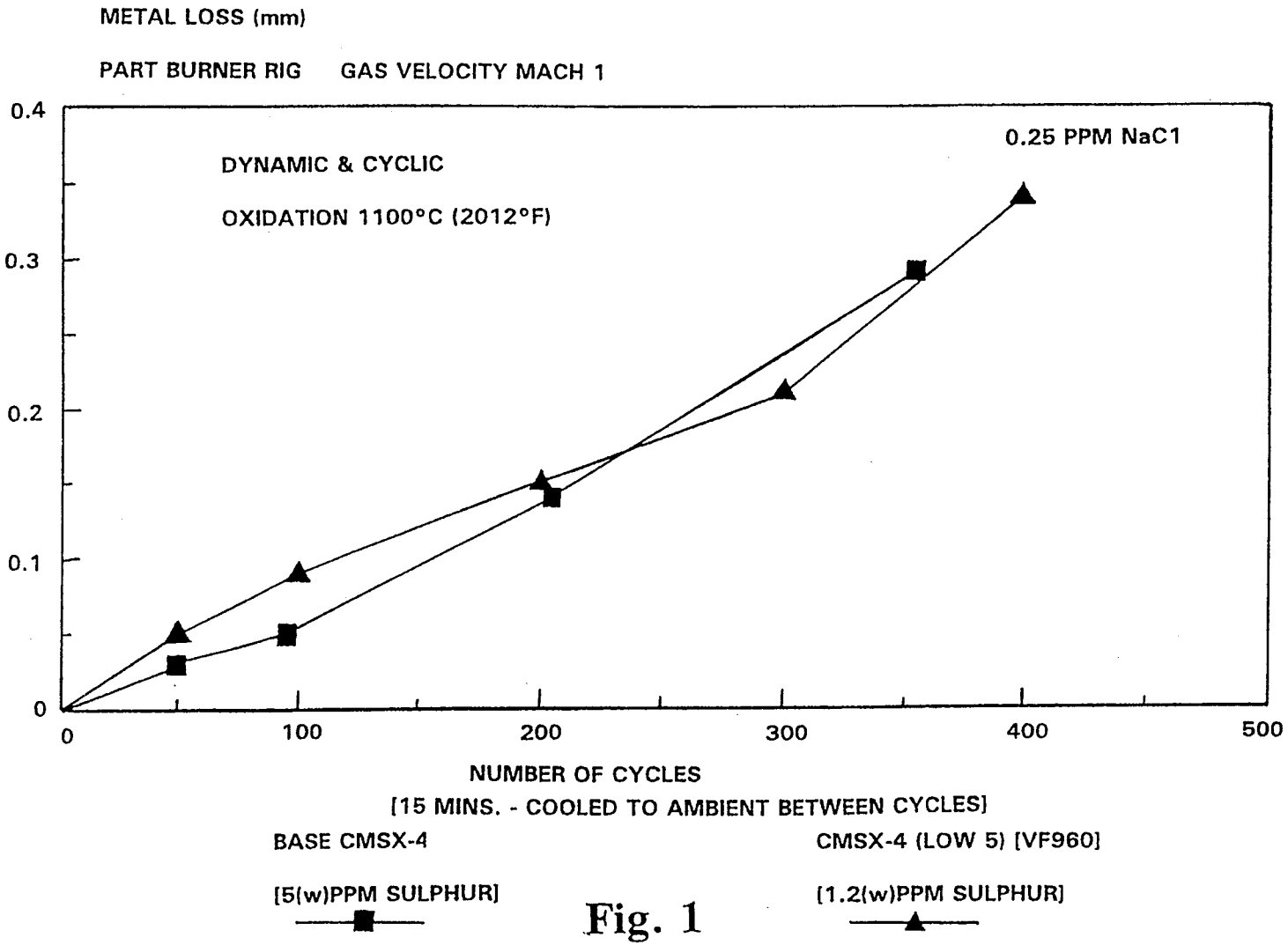
FIG. 1 is a graph of the metal loss due to dynamic, cyclic oxidation of CMSX-4 alloy containing 5 (w) ppm sulphur and 1.2 (w) ppm sulphur at Mach 1 gas velocity at 1100° C. (2012° F.) in a burner rig.

The solution to the problems described above has been found to be to limit the alloy's sulphur content to less than 2 (w) ppm and also delay and significantly reduce the addition of yttrium to the alloy to the time of vacuum remelting in preparation for single crystal casting. A further possibility is that of applying the yttrium to the completed single crystal casting after solution heat treatment by an ion-implantation process. This is possible since the yttrium can be applied by ion-implantation which will implant a very thin layer of 1000–1200 Å thickness of yttrium into the airfoil surfaces of the single crystal castings which will be exposed to very high temperatures, including cyclic transients, in high efficiency, advanced turbine engine designs.

It has been determined by tests that yttrium ion-implantation, even when extremely thin, is effective to prevent the high temperature oxidation destruction of the tips of turbine blades in very high efficiency turbine engines. Tests have shown that this very thin protective layer in the high temperature regions of the turbine blades effectively protects them by essentially eliminating spalling of the alumina scale during cyclic engine conditions, and the blades can be depended upon to remain stable over a long period of very high temperature cyclic operation. Research has shown that sulphur atoms in the alloy migrate to the high energy interface between the alumina scale layer and the base alloy during high temperature exposure and weaken its bond which leads to spalling of the scale during cyclic engine conditions. The presence of yttrium ties up the sulphur as a stable yttrium sulphide (YS) or yttrium oxysulphide ($Y_2O_2S$). The compelling factor in this research is the recognition that even small increases in temperature tolerance of the alloys for these engines permits significant increases in engine efficiency. Nowhere is this more evident than in advanced military aircraft turbines. In most industrial engines, the blade life of a turbine can be 25,000 to 100,000 hours. Blade life targets in advanced airline turbine engines can be 5,000–20,000 hours. In the engines of advanced performance military aircraft, the blade life may be only 2,000 to 2,500 hours.

This invention permits the level of yttrium to be reduced from 30–100 (w) ppm to about 5 to 15 (w) ppm in the single crystal airfoil components. This is significant for several reasons. Yttrium is a very reactive element and, therefore, yttrium that is not chemically bonded can become a serious problem resulting in the formation of yttrium oxide and oxysulphide inclusions which can nucleate grain defects. Single crystal superalloys which do not contain the grain boundary strengthening elements boron and carbon (their absence increases the alloys' incipient melting temperature) do not have any significant grain boundary strength. It may also react with nickel producing a low melting point eutectic phase which imposes high temperature strength and phase stability limitations on the alloy and, thus, on turbine engine performance. However, the presence of sulfur in the range of 3 to 5 ppm (w) or more prevents reduction of yttrium in the alloy because it requires about six parts of yttrium by weight to chemically bond or tie up one part of sulphur, based on likely formation of the yttrium oxysulphide ($Y_2O_2S$). Sulphur is also present in aviation kerosene used as fuel in aircraft turbine engines. Sulphur from the fuel may diffuse through the alumina scale layer during high temperature engine operation, thus requiring a certain excess yttrium level in the alloy to tie this sulphur up as YS. In attempting to reach this balance, it has to be kept in mind that yttrium is so reactive that only a portion of any yttrium added to the casting will be available to chemically bond to the sulphur. However, by almost eliminating sulphur, an yttrium concentration higher than 5–15 ppm is rendered unnecessary. Thus, the problem of excessive yttrium is also largely overcome. This is important because of yttrium's high reactivity with oxygen containing ceramic materials. By the reduction in sulphur, the element which causes high temperature alumina scale spalling, and with a very low 5–15 ppm (w) yttrium content, the cyclic oxidation of the turbine blades is essentially eliminated. Further, since yttrium has no function in the alloy other than the protection of the turbine blades' surface integrity, many of the characteristics of the alloy are beneficially affected by the change.

This invention will be best understood by its application to CMSX-4, U.S. Pat. No. 4,643,782, previously identified which has the composition set out on the right of the following table.

TABLE I

| | [Chemistry wt % or wt ppm] | | |
|---|---|---|---|
| | US. Pat. No. 4,643,782 A | 4,643,782 Alloy with low sulphur B | 4,643,782 Alloy with low sulphur and yttrium C |
| Co | 9.3–10.0 | 9.3–10.0 | 9.3–10.0 |
| Cr | 6.4–6.6 | 6.4–6.6 | 6.4–6.6 |
| Mo | 0.5–0.7 | 0.5–0.7 | 0.5–0.7 |
| W | 6.2–6.6 | 6.2–6.6 | 6.2–6.6 |
| Ta | 6.3–6.7 | 6.3–6.7 | 6.3–6.7 |
| Al | 5.45–5.75 | 5.45–5.75 | 5.45–5.75 |
| Ti | 0.8–1.2 | 0.8–1.2 | 0.8–1.2 |
| Hf | 0.07–0.12 | 0.07–0.12 | 0.07–0.12 |
| Re | 2.8–3.2 | 2.8–3.2 | 2.8–3.2 |
| Ni | Balance | Balance | Balance |
| C | 60 ppm max. | 60 ppm max. | 60 ppm max. |
| Zr | 50 ppm max. | 50 ppm max. | 50 ppm max. |
| B | 30 ppm max. | 30 ppm max. | 30 ppm max. |
| S | 20 ppm max. | 2 ppm max. | 2 ppm max. |
| Si | 400 ppm max. | 400 ppm max. | 400 ppm max. |
| Y | — | — | 5–15 ppm |

The composition set out on the left is that alloy disclosed in said U.S. Pat. No. 4,643,782. That alloy generally contains 5–10 ppm of sulphur. The alloy set out in the middle column is that of the alloy when the sulphur in the alloy is limited to less than 2 (w) ppm, typically close to 1 (w) ppm. The alloy set out in the last column to the right is that which results when the alloy of column B also includes only 5–15 ppm yttrium. The alloy of the column on the right depends upon maintaining the very low sulphur content of less than 2 (w) ppm because only then can the yttrium content be significantly reduced. By materially reducing the sulphur content, it is possible to confine the yttrium to that necessary to react with and form stable sulphides (YS) with the small remaining amount of sulphur in the alloy and from the fuel environment.

Figure 2:
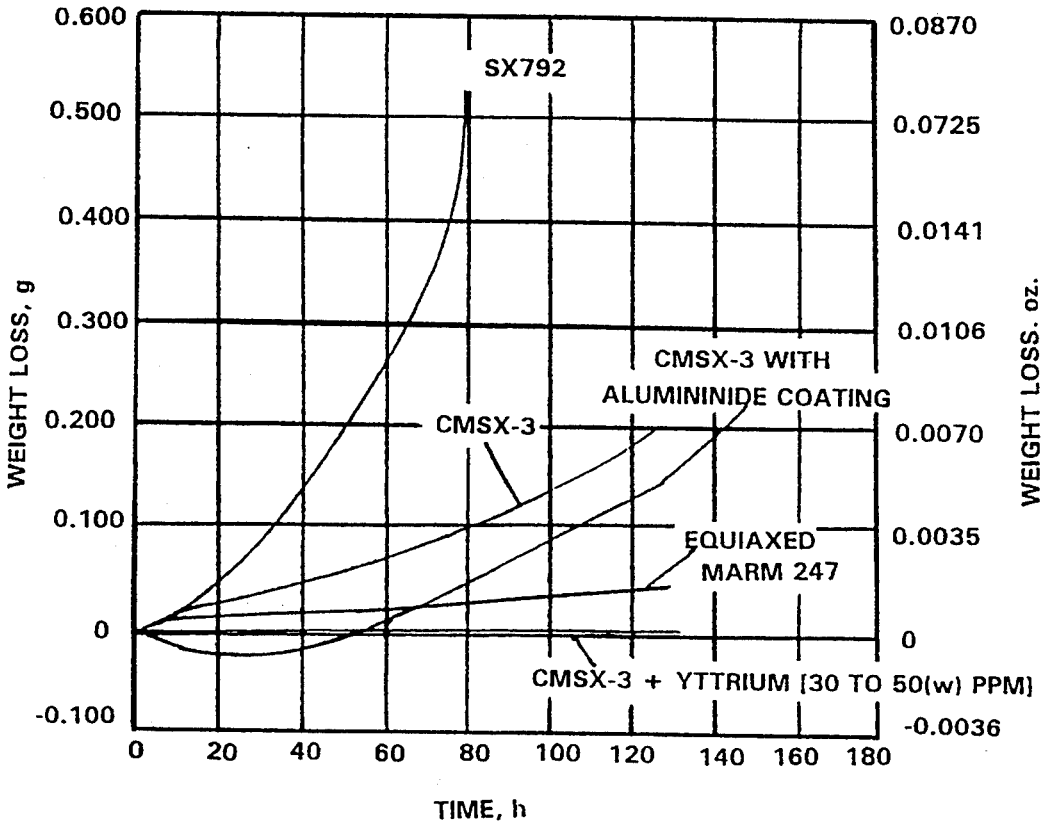
FIG. 2 is a graph of the effect on metal loss resulting from dynamic, cyclic oxidation of CMSX-3 single crystal alloy with and without yttrium at 1177° C. (2150° F.)
Figure 3:
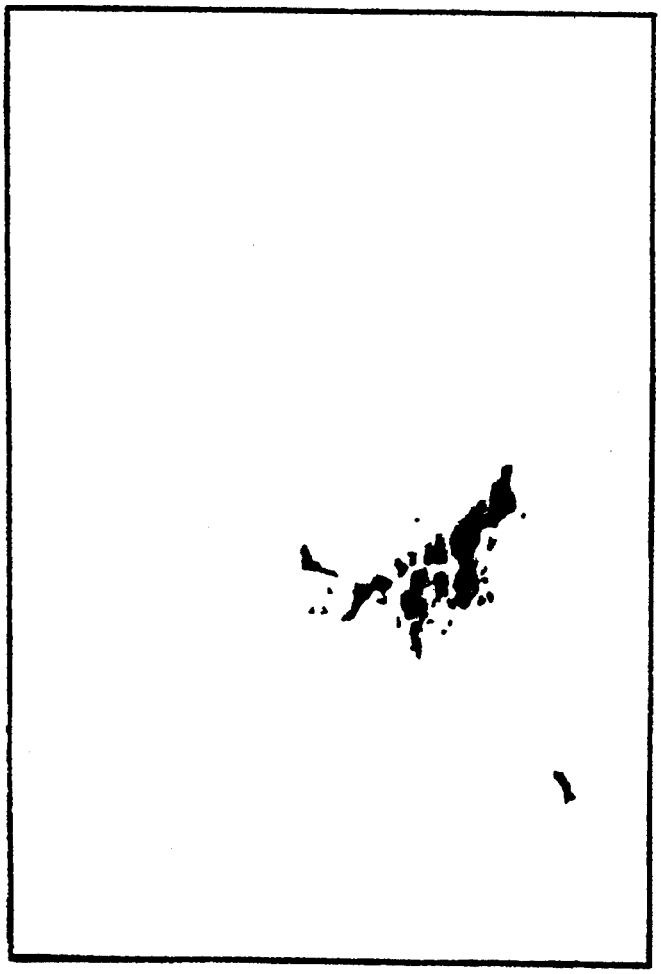
FIG. 3 is a drawing based on a micro-photograph of nickel yttrium low melting point eutectic phase in CMSX-4 alloy with 30 ppm yttrium.

As illustrated in FIG. 1 of the drawings, it will be noted that burner rig cyclic oxidation at 1100° C. (2012° F.) of bare CMSX-4 alloy is not improved when the sulphur is reduced from 5 ppm (w) in the base alloy to 1.2 (w) ppm in experimental heat VF 960 of CMSX-4. These results are in contrast to those laid out in U.S. Pat. No. 4,895,201, issued Jan. 23, 1990, to DeCrescente et al. and assigned to United Technologies Corporation particularly in Example III Column 6. However, it should be noted that work described in that patent did not cover CMSX-4 alloy. However, by reducing sulphur to 0.9–1.2 ppm and reducing yttrium into the range of 5–15 (w) ppm, it was found that the yttrium chemically bonded with the remaining sulphur. Thus, even this small amount of sulphur will be prevented from reacting with the aluminium oxide scale on CMSX-4 alloy and, thus, prevent spalling of this protective oxide scale and attack of the surface integrity of the tip regions of turbine blades during high temperature, cyclic turbine engine operation. FIG. 2 shows the dramatic increase in dynamic, cyclic oxidation resistance at 1177° C. (2150° F.) of CMSX-3 single crystal alloy containing 5 (w) ppm sulphur with 30–50 (w) ppm yttrium. It is postulated at this time that similar oxidation improvement will be apparent with CMSX-4 alloy containing less than 2 (w) ppm sulphur with 5–15 (w) ppm yttrium, compared to base CMSX-4 alloy with 5–10 (w) ppm sulphur.

It will be understood from the preceding description that merely reducing the sulphur in the turbine airfoils of CMSX-4 single crystal alloy to less than 2 (w) ppm does not alone solve the problem of sulphur's destructive effects upon the high temperature surface integrity of the tip regions of the turbine blade castings. It is the additional step of providing a limited amount of yttrium to bond with and chemically neutralize any remaining sulphur by making it unavailable for reaction with the aluminium oxide scale layer on the turbine blades. As has been pointed out, this can be done either by the addition of yttrium to the base alloy during remelting prior to single crystal casting or by ion-implanting those surfaces of the completed casting which will be exposed to the high temperature oxidizing combustion gases with a very thin layer of yttrium which will serve to tie up the sulphur which may be in both the combustion gases and base alloy. It is also possible to obtain the results of this invention by substituting either lanthanum or cerium either in part or totally for yttrium in a range of 5–20 ppm (w) in the single crystal castings. Both lanthanum and cerium, like yttrium form extremely stable sulphides and oxysulphides since they have a very high affinity for sulphur and oxygen similar to yttrium. Slightly higher amounts of each of these elements are required because of their increased atomic weight as compared to yttrium.

Irrespective of the use of a nickel-base alloy with a sulphur content of not more than 2 ppm by weight and 5–15 ppm by weight of yttrium or the use in substitution for the yttrium either of lanthanum or cerium at a weight percentage higher than that of yttrium made necessary by their higher atomic weight as compared to yttrium, the elimination of the detrimental effects of sulphur to the turbine engine blades, vanes and other engine components exposed thereto is the same.

Irrespective of which technique is used to protect the turbine blades it will be understood that the invention materially extends the effective life span of the turbine blades in advanced, high efficiency turbine engines.

We claim:

1. An improved nickel based superalloy for casting single crystal turbine engine blades, vanes or combustion components for use at operating temperatures up to 2100° F. without incipient melting porosity, said alloy consisting essentially of the following elements in the following proportions expressed as percentages of weight except where otherwise noted as ppm by weight:

| | |
|---|---|
| Co | 9.3–10.0 |
| Cr | 6.4–6.6 |
| Mo | 0.5–0.7 |
| W | 6.2–6.6 |
| Ta | 6.3–6.7 |
| Al | 5.45–5.75 |
| Ti | 0.8–1.2 |
| Hf | 0.07–0.12 |
| Re | 2.8–3.2 |
| S | 2 ppm max. |
| P | 2 ppm max. |
| La | 5–20 ppm |
| Ni | Balance. |

2. An improved nickel based superalloy for casting single crystal turbine engine blades, vanes or combustion components for use at operating temperatures up to 2100° F. without incipient melting porosity, said alloy consisting essentially of the following elements in the following proportions expressed as percentages of weight except where otherwise noted as ppm by weight:

| | |
|---|---|
| Co | 9.3–10.0 |
| Cr | 6.4–6.6 |
| Mo | 0.5–0.7 |
| W | 6.2–6.6 |
| Ta | 6.3–6.7 |
| Al | 5.45–5.75 |
| Ti | 0.8–1.2 |
| Hf | 0.07–0.12 |
| Re | 2.8–3.2 |
| S | 2 ppm max. |
| P | 2 ppm max. |
| Ce | 5–20 ppm |
| Ni | Balance |

3. An improved nickel based superalloy for casting single crystal turbine engine blades, vanes or combustion components for use at operating temperatures up to 2100° F. without incipient melting porosity, said alloy consisting essentially of the following elements in the following proportions expressed as percentages of weight except where otherwise noted as ppm by weight:

| | |
|---|---|
| Co | 9.3–10.0 |
| Cr | 6.4–6.6 |
| Mo | 0.5–0.7 |
| W | 6.2–6.6 |
| Ta | 6.3–6.7 |
| Al | 5.45–5.75 |
| Ti | 0.8–1.2 |
| Hf | 0.07–0.12 |
| Re | 2.8–3.2 |

-continued

| | |
|---|---|
| S | 2 ppm max. |
| P | 2 ppm max. |
| Y + La | The amounts of Y + La in ppm being such that the combined number of atoms of the yttrium plus lanthanum would equal the number of atoms of yttrium in the amount of 5–15 ppm if yttrium alone had been added to the alloy and La is present in the amount of at least 5 ppm |
| Ni | Balance |

4. An improved nickel based superalloy for casting single crystal turbine engine blades, vanes or combustion components for use at operating temperatures up to 2100° F. without incipient melting porosity, said alloy consisting essentially of the following elements in the following proportions expressed as percentages of weight except where otherwise noted as ppm by weight:

| | |
|---|---|
| Co | 9.3–10.0 |
| Cr | 6.4–6.6 |
| Mo | 0.5–0.7 |
| W | 6.2–6.6 |
| Ta | 6.3–6.7 |
| Al | 5.45–5.75 |
| Ti | 0.8–1.2 |
| Hf | 0.07–0.12 |
| Re | 2.8–3.2 |
| S | 2 ppm max. |
| P | 2 ppm max. |
| Y + Ce | The amounts of Y + Ce in ppm being such that the combined number of atoms of the yttrium plus cerium would equal the number of atoms of yttrium in the amount of 5–15 ppm if yttrium alone had been added to the alloy and Ce is present in the amount of at least 5 ppm |
| Ni | Balance |

* * * * *

UNITED STATES PATENT AND TRADEMARK OFFICE

CERTIFICATE OF CORRECTION

PATENT NO. : 5,443,789

DATED : August 22, 1995

INVENTOR(S) : Kenneth Harris, et. al.

It is certified that error appears in the above-indentified patent and that said Letters Patent is hereby corrected as shown below:

Title page, item [57],
Abstract, Line 4;
After ", or" insert – yttrium –;

Abstract, Line 7;
After "used in" insert – turbine –;

Column 4, line 58;
After "that" insert – of the –.

Signed and Sealed this

Seventh Day of May, 1996

Bruce Lehman

*Attest:*

BRUCE LEHMAN

*Attesting Officer*

*Commissioner of Patents and Trademarks*